US005481841A

United States Patent [19]

Osborn

[11] Patent Number: 5,481,841

[45] Date of Patent: Jan. 9, 1996

[54] VARIABLY ASSEMBLABLE FIGURATIVE TILE SET FOR COVERING SURFACES

[76] Inventor: John A. L. Osborn, 250 Donegal Way, Martinez, Calif. 94553

[21] Appl. No.: 317,899

[22] Filed: Oct. 4, 1994

[51] Int. Cl.[6] ..... A63F 9/10; E04F 13/00; E04F 15/00

[52] U.S. Cl. ..... 52/311.2; D21/105; D25/138; 273/157 R

[58] Field of Search ..... 52/311.2, 311.1, 52/608; D25/138; D21/104, 105, 108; 404/41, 42; 273/292, 293, 294, 153 R, 156, 157 R, 160

[56] References Cited

U.S. PATENT DOCUMENTS

| | | | |
|---|---|---|---|
| D. 169,482 | 5/1953 | Henke et al. | 273/157 R |
| 751,275 | 2/1904 | Flint | 52/311.2 |
| 799,681 | 9/1905 | Sloan | 52/311.2 |
| 909,311 | 1/1909 | Janin | 52/311.2 |
| 4,133,152 | 1/1979 | Penrose | 273/157 R |
| 4,217,740 | 8/1980 | Assanti | 52/311 |
| 4,350,341 | 9/1982 | Wallace | 273/157 R |

FOREIGN PATENT DOCUMENTS 43542 12/1930 Denmark .

OTHER PUBLICATIONS

"The World of M. C. Escher", published by Harry N. Abrams, Inc. 1971, pp. 18, 80, 130.

"Theory of Tiles", Scientific American, Jan. 1977, pp. 110–112, 115–121.

"New Mathematical Pastimes", Macmahon, 1921, pp. 106–112.

J. A. L. Osborn, "Amphography The Art of Figurative Tiling", in *Leonardo,* vol. 26 #4, pp. 289–291, 1993.

*Primary Examiner*—Carl D. Friedman
*Assistant Examiner*—Laura A. Saladino

[57] ABSTRACT

A set of tiles for covering a surface is composed of eight distinct shapes that are insect-like in that they are bilaterally symmetrical and have six leg-like projections. Each sort of tile will fit together with another tile of the set in an average of nine different ways. The tiles may be assembled jig-saw-puzzle fashion in an infinite number of distinct tilings. Ten different subsets of the eight insect-like or beetle-like tiles will tile the plane, some in several highly distinctive manners. The many and variable tiling patterns have considerable aesthetic appeal. They may be used as fabric prints, wall coverings, and the like, or as jewelry designs, or as highly efficient patterns for shaped cookies, etc. The tiles of the invention may also be used as teaching aids, or as puzzle pieces in an unlimited number of different puzzles of every level of simplicity or difficulty.

1 Claim, 3 Drawing Sheets

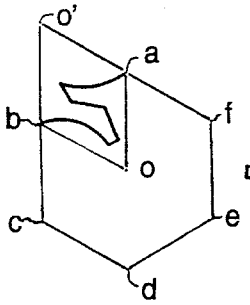
FIG. 1
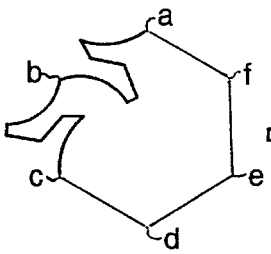
FIG. 2-A
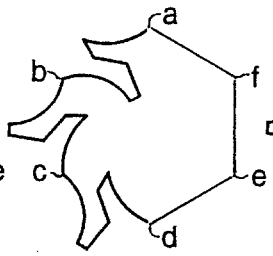
FIG. 2-B
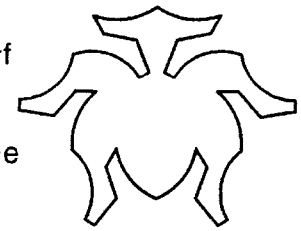
FIG. 2-C
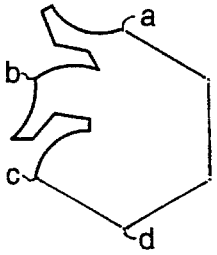
FIG. 3-A
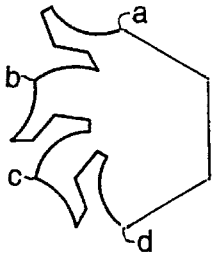
FIG. 3-B
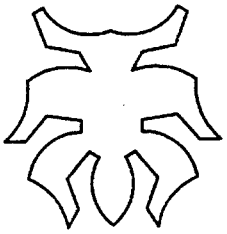
FIG. 3-C
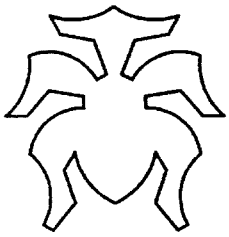
FIG. 4-A
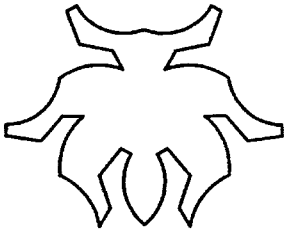
FIG. 4-B
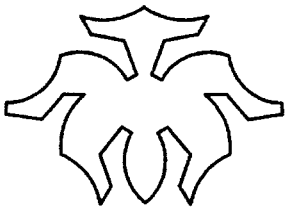
FIG. 5-A
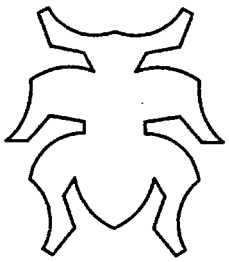
FIG. 5-B
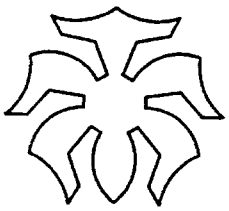
FIG. 6-A
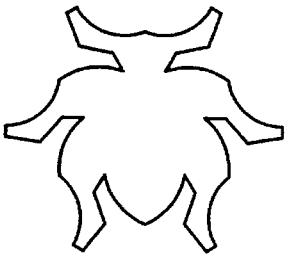
FIG. 6-B

VARIABLY ASSEMBLABLE FIGURATIVE TILE SET FOR COVERING SURFACES

BACKGROUND—OF THE INVENTION

This invention relates to the field of tiles and tilings. The field includes the familiar floor and kitchen-counter top tiles and tilings of commerce and their like, but also extends to the sometimes more abstract areas of art, design, and mathematics.

1. Some Definitions

I have adapted a few of the notions and definitions of the mathematics of tiles and tilings as follows. A tile is a two-dimensional closed shape which fits together edge-to-edge with other different or similar two-dimensional shapes, as do jig-saw puzzle pieces or bricks, to cover a flat surface of indefinite extent. Such a covering is called a tiling if it has no gap between tiles nor any overlap of one tile on another. Adding thickness to a two dimensional tile will make it a three dimensional object which is also called a tile. A tile or a set of tiles is said to "tile the plane" if indefinitely large numbers of duplicates of the tile or of the members of the set of tiles can fit together without gap or lap in a tiling. The term "the plane" refers to the flat indefinitely extensive plane of Euclidian geometry. As a verb, "tile" means to form a tiling.

A figurative tile is one whose shape is the recognizable outline, or figure, of a person or an animal. A figurative tiling is a tiling composed of such figurative tiles. Examples of such figurative tiles and tilings are to be found in the work of the late Dutch artist, M. C. Escher.

A variably assemblable tiling is one whose tiles function so as to fit together or to interlock with one another in a variety of different ways, allowing a plurality of different tilings to be made. Perhaps the simplest tile to form such a plurality is the common brick with its many different arrangements and patternings in walls and pavings. Sets of curved sided tiles that are variably assemblable are somewhat more difficult to design, as may be seen in U.S. Pat. No. 4,217,740 of Aug. 19, 1980 to Assanti.

2. Prior Art

U.S. Pat. No. 4,133,152 of Jan. 9, 1979 to Penrose shows a crudely figurative and variably assemblable set of two tiles that has since become known as "Penrose's chickens". This is the only known variably assemblable figurative tile set that is not the work of the present inventor, John A. L. Osborn.

Though Penrose's underlying geometry is of seminal importance, these "chicken" shapes have many disadvantages both when it comes to forming aesthetically pleasing tilings and when the tiles are to act as pieces in a puzzle.

(a) There are only two different shapes in this "chicken" set. Thus there is little variety in the pieces to interest the eye, and the options for tile choice in assembling a puzzle are severely limited.

(b) The two pieces can fit together in only four ways, which is such a low number of options that it adds virtually nothing to the perceived complexity of a puzzle. Nor does it add significantly to the visual interest of a tiling used for aesthetic effect.

(c) The "chicken" shapes almost entirely lack the emblematic quality of clear recognizability that a figurative tile outline should have in order to convey the significance of its shape to the viewer even when it is surrounded by a swirl of differently oriented similar shapes as it is in a tiling. When viewing a patch of "chicken" shapes one's eye tends to see only lumps and bumps. The geometric shapes they derive from are much more attractive and interesting.

(d) For use as puzzle pieces the non-interlocking quality of the "chicken" shapes makes them easily jostled into disorder, and hard to move and save for a later session of play.

(e) In working with the "chicken" tiles, it does not quickly become apparent that there are many possible tilings. Certain combinations of a few tiles occur again and again, and one has to assemble a very large number of tiles before it becomes apparent that indeed the larger patterns do not repeat periodically. Of recent years the Penrose non-repetitive tilings, including the Penrose chickens, have come to be called "quasiperiodic", a name that calls attention to the fact that they give the impression of being periodic, or repetitive.

OBJECTS AND ADVANTAGES

My invention comprises a set of eight beetle-shaped tiles which provides, correspondingly, advantages over the prior art as follows.

(a) There are at least ten distinct subsets of my eight-beetle set which will tile the plane. Five of these are capable of doing so in an infinite number of different ways. The full eight member set is one of this latter group of five subsets.

(b) Any single one of my beetle tiles will fit together one-on-one with the other beetle tiles, including a duplicate of itself, in a total of 72 distinct ways. This provides a great variety of choice in assembling a tiling, as, for instance, in doing a puzzle where a defined border is to be filled in. It also allows the creation of interestingly shaped and aesthetically pleasing patches of tiles. Some of these patches of tiles may be extensible indefinitely, while others may have self-defined geometric outlines by virtue of the development of untilable borders.

(c) Each of the beetle tiles has a family resemblance to the others in the eight member set, but their six-legged shapes are quite distinct while also being emblematically insect-like even without the embellishment of internal drawing. Even when surrounded by other beetle shapes each beetle is distinct.

(d) My beetle tiles interlock in such a way that a tiled patch of puzzle pieces can be slid around on a table surface quite freely without disturbing the arrangement of the tiles.

(e) People working or playing with my beetle tiles become aware almost immediately that there are a variety of ways to tile a surface with them, even though it takes a while to realize the full extent of that variety.

In view of these advantages, it is a primary object of my invention to provide an inexhaustible number of puzzles of every level of difficulty.

Further objects and advantages of my variably assemblable set of eight beetle-shaped tiles are to provide a wide variety of designs for decorating or covering surfaces. Such decoration need not completely cover the surface, but instead may be in the form of patches of different,and perhaps differently colored, beetle shapes, or in the form of friezes or other border decoration. It is an object of the invention to provide a variety of beetle tilings which will tile a cylindrical surface for seamless covering of architectural surfaces and for continuous printing or die cutting of beetle tilings or beetle shapes. Eight of the ten tiling subsets of the eight-member beetle set will tile cylindrical surfaces for such purposes of decor or production, and may do so in several orientations. It is an advantage of the invention that an assembled tiling provides a design for cutting dies wherein there are no interstices between the shapes to be produced by cutting. Consequently, no scrap is produced in the cutting operation. The efficient cutting of a variety of beetle shapes from dough without generating scraps that require reprocessing is particularly interesting in the following regard.

"Eat a bug!" has been a popular dare with kids since time immemorial. The eight beetle shapes would have considerable popularity in this regard if used as forms for cookies or crackers. Accordingly, it is an object of my invention to provide beetle shapes for cookies, crackers, or other comestibles, and to enable these to be manufactured with the exceptional efficiency explained above. Furthermore, with a dough displaying good dimensional stability through the cooking process, such cookies or crackers might, in play, be assemblable into tilings.

Further objects and advantages of my variably assemblable figurative tile sets will become apparent from consideration of the drawings and the ensuing description.

BRIEF DESCRIPTION OF THE DRAWINGS

FIG. 1 shows an example of a pattern line and the limits within which it must lie.

FIG. 2-A shows a pattern-formed initial side of a hexagon, and its rotation in the plane to form a second contiguous side.

FIG. 2B shows how the second side has been snaked (ie: moved endwise, or end-on) in the plane to form a third contiguous side and thus to complete a hemiperimeter (ie.: a half-perimeter) of the hexagon.

FIG. 2-C shows the reflection (a movement not in the plane) of the pattern-formed hemiperimeter as a unit across the hexagon to complete the bilaterally symmetrical tile outline. The characterizing sequence of operations has been :rotate, snake.

FIG. 3-A shows a second hexagon in which the initial side has been rotated 180 degrees from the position shown in FIG.2-A, and its rotation to form a second side. FIG. 3-B shows the arrangement of FIG. 3-A extended by snaking the second side to form third side.

FIG. 3-C shows the reflection of the formed hemiperimeter as a unit to complete a second and different bilaterally symmetrical tile outline. In FIG. 3, also, the characterizing sequence of operations has been: rotate, snake. (Consequently the two tile shapes derived in FIGS. 2-A to 2-C and 3-A to 3-C make up the named subset, Rotate-Snake, of the eight tile family of beetle shapes characterized by the pattern line which was designed in FIG. 1.)

FIG. 4-A shows a first tile derived by the characterizing sequence: snake, rotate.

FIG. 4-B shows a second tile derived by the sequence: snake, rotate. (The tiles of FIGS. 4-A and 4-B make up the named subset ,Snake-Rotate.)

FIG. 5-A shows a first tile derived by the sequence: rotate, rotate.

FIG. 5-B shows a second tile derived by the sequence: rotate, rotate. (The tiles of FIGS. 5-A and 5-B make up the named subset, Rotate-Rotate.)

FIG. 6-A shows a first tile derived by the sequence: snake,snake.

FIG. 6-B shows a second tile derived by the sequence: snake,snake. (The tiles of FIGS. 6A and 6-B make up the named subset Snake-Snake.)

SUMMARY OF THE INVENTION

Figure 7:
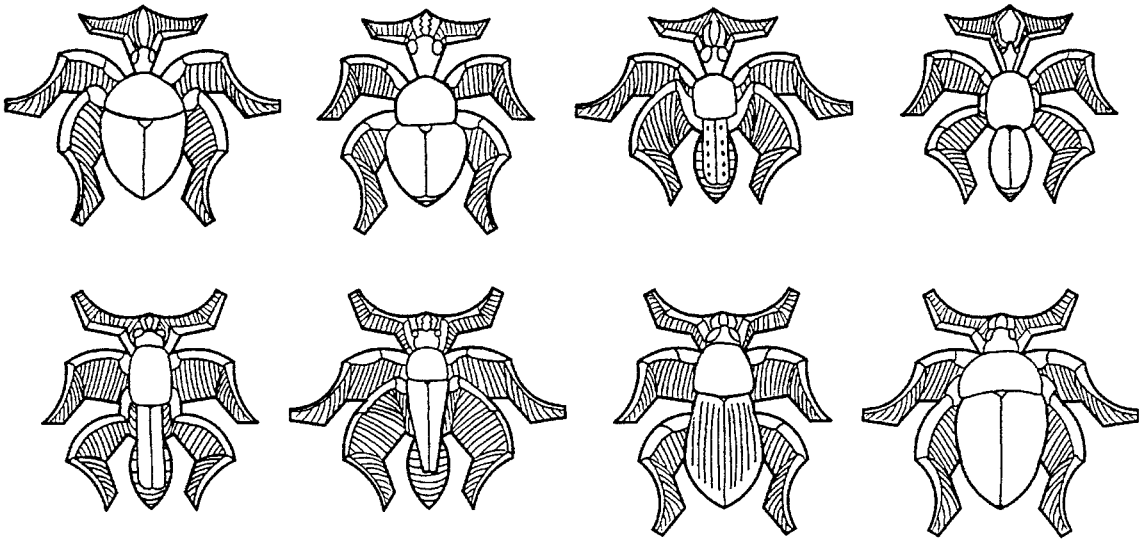
FIG. 7 shows the eight tile outlines embellished by internal drawing.

My eight member set of variably assemblable beetle-shaped tiles can best be described by outlining the method by which it was designed. Briefly, the method is as follows: a side of a regular hexagon was judiciously modified, and this side, as a pattern, was used to shape the three sides constituting a hemiperimeter of the hexagon. Then, turning and moving the pattern only in the plane, the procedure was repeated in seven more regular hexagons of the same size, so as to exhaust all possible arrangements of the pattern in forming single hemiperimeters of the hexagons. Each of these different arrangements was then reflected across its respective hexagon to complete a bilaterally symmetrical tile outline which was different from each of the other seven outlines. Thus a single deeply recurved line segment gave interlocking shape to each of the forty-eight sides of eight hexagons so as to ensure that they would fit together in many ways, and at the same time gave a recognizable bilaterally symmetrical insect-like shape to each of the eight hexagons. A somewhat different pattern line, if used in the forgoing manner, would produce an eight-member family of outlines of a somewhat different character. The particular family of beetle-like outlines shown in the drawings is, however, the preferred embodiment of my invention.

Detailed Description of the variably assemblable eight beetle tile set

My invention provides eight-member sets of variably assemblable figurative tiles. The preferred embodiment shown in the drawings is a set of eight different beetle-like tiles. A certain pattern line forms and characterizes each member of the preferred eight-member set shown in the figures. This pattern line is the subject of FIG. 1, and is repeated many times in all the subsequent drawing figures. A somewhat different pattern line would produce or create a different family of eight shapes, and these shapes might be more, or might be less, insect-like than those of my preferred embodiment.

FIG. 1 shows pattern line a-b which has replaced one side of a hexagon. This line, much repeated in different positions, makes up and characterizes each member of the preferred embodiment of my invention, and is responsible for their insect-like outlines. The recurved line a-b is asymmetrical. If such a pattern line were symmetrical it would not produce a useful multi-member figurative tile set. Any non-straight and asymmetrical line between point a and point b which avoids touching or crossing either itself or the sides of the rhombus a-o-b-o' will yield, following a method like the one employed in this description, eight related shapes which will tile the plane in ways similar to the ways in which the eight-beetle family shown in the drawings tiles the plane.

FIG. 2-A shows line a-b replacing an initial side of a regular hexagon, just as in FIG. 1. Also shown is a second side formed by rotating the pattern of the initial side around point b to form side b-c. This rotation of the pattern is in the plane. A motion "in the plane " means that the pattern can be slid and turned while lying flat, but may not be lifted or turned "out of the plane" (ie. :it may not be flipped over).

FIG. 2-B shows a third side which is formed by snaking, or moving endwise, the pattern of side b-c to form side c-d. This operation completes the shaping of three contiguous sides of the first hexagon. Three such contiguous shaped sides constitute a half-perimeter, or hemiperimeter, of a hexagon.

FIG. 2-C shows the hemiperimeter formed in the preceding figures reflected as a unit across its hexagon to complete a bilaterally symmetrical insect-like tile outline. Reflection is an operation not in the plane. It can be thought of as requiring a pattern to be lifted and flipped over. A pattern which has been reflected may alternatively be thought of as being the mirror image of its original, hence the operation's name: "reflection".

FIG. 3-A shows a second hexagon. The initial side of this hexagon differs from that of the hexagon in FIG. 2-A only in that it has been rotated 180 degrees, or end-for end, in the plane. Also shown is a second side formed by rotation of the initial side around point b. Notice how these two sides differ from those shown in FIG. 2-A.

FIG. 3-B shows the arrangement of FIG. 3-A extended by snaking the second side to form a third side, thus completing a hemiperimeter of the second hexagon. Notice how this third side differs from that shown in FIG. 2-B.

FIG. 3-C shows the hemiperimeter formed in FIG. 3-B, and also shows this hemiperimeter reflected as a unit to complete a second and different bilaterally symmetrical tile outline. In FIGS. 3-A and 3-B, just as in FIGS. 2-A and 2-B, the characterizing sequence of operations has been: "rotate", and then "snake". In order to facilitate the description, under the title "Operation " below, of how these eight-member families of tiles tile the plane, I have named four subsets, of two tiles each, which make up a full eight-member set. The first of these subsets has been described and shown in FIGS. 2-A, -B, -C and 3-A, -B, -C, and is named, after the characterizing operations and their sequence, the Rotate-Snake subset. The other three named subsets will be the Snake-Rotate, the Rotate-Rotate, and the Snake-Snake subsets, all named on a similar basis. Any eight-member family of tiles derived by the method explained herein, or one effectively like it, will have these four subsets.

FIG. 4-A shows a tile of the preferred embodiment which has been derived by the characterizing sequence "snake-rotate". The initial side has the same orientation as that in FIG. 2-A. As in the other beetles, reflection has completed the bilaterally symmetrical outline.

FIG. 4-B shows the second tile derived by the sequence "snake-rotate". Note that this tile's initial side differs from that of FIG. 4-A in being turned end-for-end, so that it has the same orientation as that of FIG. 3-A The two tiles of FIGS. 4-A and 4-B make up the Snake-Rotate subset of the preferred embodiment.

FIG. 5-A shows a first tile derived by performing the sequence of operations called "rotate-rotate" on an initial side oriented the same as those in FIGS. 2-A and 4-A. The beetle figure or shape was completed by reflection as in the other beetle shapes.

FIG. 5-B shows the second tile derived by the sequence "rotate-rotate". The patterned initial side is in the same position as those shown in FIGS. 3-A and 4-B. The two tiles of FIGS. 5-A and 5-B make up the Rotate-Rotate subset of the preferred embodiment.

FIG. 6-A shows a first tile derived by the sequence "snake-snake". The patterned initial side is in the same position as those of FIGS. 2-A, 4-A and 5-A. The figurative tile shape is shown completed by reflection of the formed hemiperimeter across the hexagon.

FIG. 6-B shows the second tile derived by the sequence "snake-snake". Starting with the initial side in the same position as those shown in FIGS. 3-A, 4-B and 5-B, the pattern was snaked to the second side, and snaked again to form the third side, after which the three sides were reflected as a unit across the hexagon to complete the eighth beetle shape. The two tiles of FIGS. 6-A and 6-B make up the Snake-Snake subset of the preferred embodiment.

FIG. 7 shows all eight beetle-like tiles of the preferred embodiment embellished by internal drawing.

Figure 8:
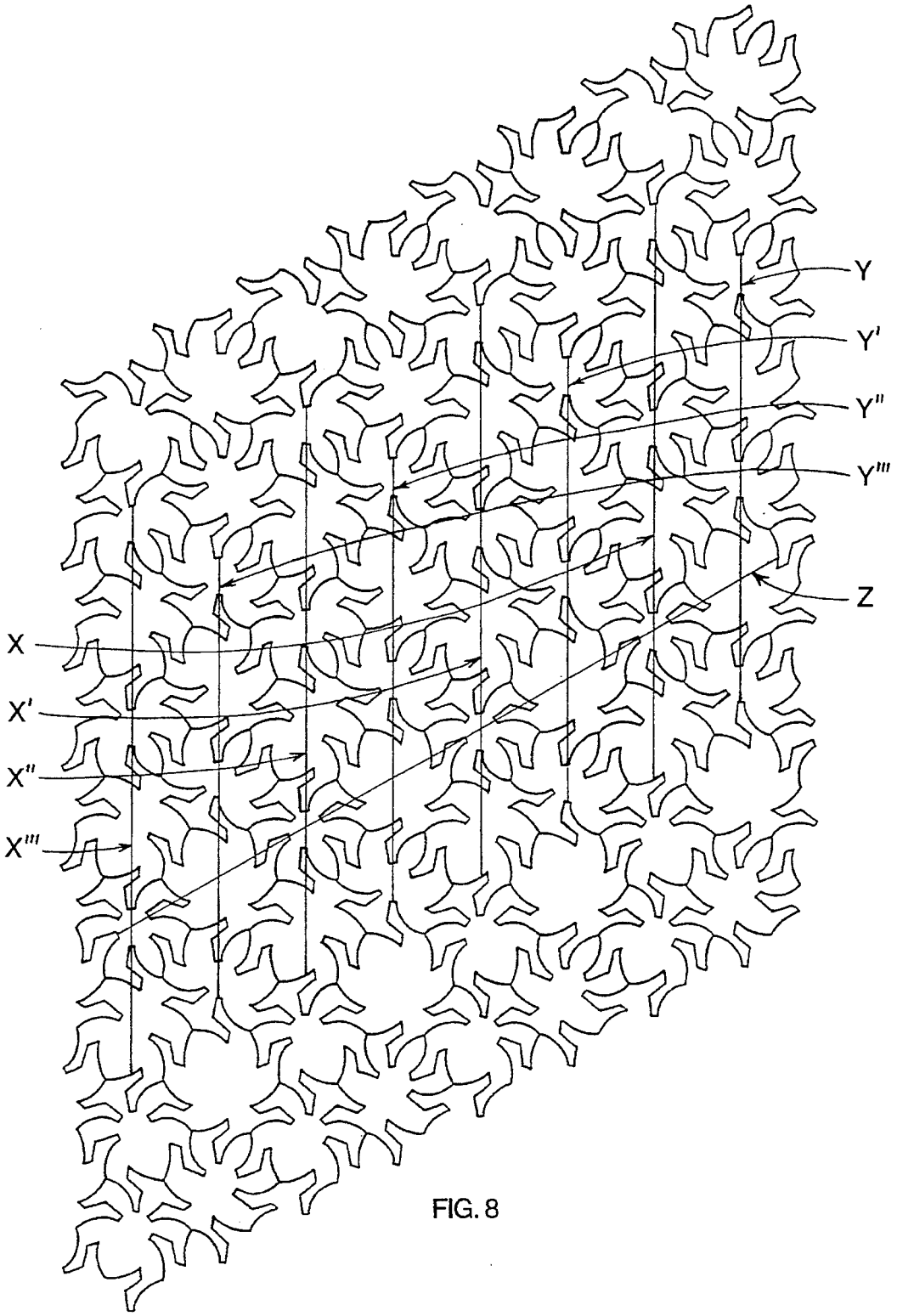
FIG. 8 shows a patch of beetle-shaped tiles composed of all eight beetle shapes derived in the forgoing figures.

FIG. 8 shows a rhomboidal area tiled by all eight sorts of beetles, but primarily by beetles of the Rotate-Rotate subset. The columns labeled X, X', X", and X"' contain upward facing beetles of the Rotate-Rotate subset. The columns labeled Y, Y', Y", and Y"' contain downward facing beetles of the same subset. Crossing these columns, and labeled Z, is a side-by-side rank of the two beetles of the Snake-Snake subset. Unlabeled beetles of the Snake-Rotate and the RotateSnake subsets form the top and the bottom border areas of the rhomboidal tiled patch. No more beetles of any sort can be fitted either to the top or to the bottom border in a compact way that does not leave untilable gaps. This demonstrates the development of untilable borders. The other two borders of the rhomboidal patch (ie.: the vertical borders on the left and the right) are identical to one another in configuration. Consequently this rhomboidal patch can be wrapped around a cylinder to tile it without gap or lap.

Operation of the Beetles in Forming Tilings

No single tile of an eight member set of tile shapes derived from regular hexagons in the manner described above, or in any effectively similar manner, will tile the plane by itself. However, any such eight member set comprises at least ten different subsets, including the subset of all eight shapes, each of which will tile the plane.

Four two-member subsets make up a full eight-member set. I have named each of these four subsets according to the distinctive sequence of operations used to create both their member shapes. For all embodiments these subsets are the Rotate-Snake subset exemplified in FIGS. 2-C and 3-C; the Snake-Rotate subset exemplified in FIGS. 4-A and 4-B; the Rotate-Rotate subset exemplified in FIGS .5-A and 5-B; and the Snake-Snake subset exemplified in FIGS. 6-A and 6-B. These four groups of two beetles each make up the four named subsets. Reference will also be made to unnamed subsets having four or six members.

In the following description of the operation of the invention I shall be referring only to the preferred embodiment illustrated in the drawings. Thus, for example, "the Rotate Rotate subset" will henceforth refer to the Rotate-Rotate subset of the preferred embodiment. Nevertheless, other embodiments with their subsets bearing these same names operate the same way as the preferred embodiment.

The Rotate-Snake subset will tile the plane by itself in the following manner: a nose-to-tail file of one sort of beetle is flanked by a nose-to-tail file of beetles of the other sort facing or "going" in the other direction, and so on indefinitely. In such nose-to-tail files, these beetles, and beetles of the Snake-Rotate subset as well, face alternately thirty degrees right and then thirty degrees left of the long axis of the file.

The Snake-Rotate subset will tile the plane by itself in a manner exactly similar to that of the Rotate-Snake subset just described.

The Rotate-Rotate subset will tile the plane by itself if three beetles of one sort are fitted together in a tight gap-free triangle, and these are surrounded by nine beetles of the other sort, which are in turn surrounded by fifteen beetles of the first sort, and so on ad infinitum in widening hexagons of alternating sorts of beetles, each successive hexagon numbering six more beetles than the last. This tiling's core of three beetles might circle either clockwise or counterclockwise. In either case the direction the core turns determines the directionality of the beetles in the subsequent surrounding hexagons. But clockwise or counterclockwise, it is the same tiling, for one is simply the mirror image of the other, or in other words, one tiling is just the other one flipped over.

The Rotate-Rotate subset will form another tiling of concentric hexagons in which the core group of three beetles is composed of three beetles of the other sort.

As shown in FIG. 8, the Rotate-Rotate subset also tiles the plane in straight columns. These columns' long axes are labeled X, X', X", X'", Y,Y', Y", and Y'". Each column is made up of the two sorts of beetle in alternation. Alternate columns face in opposite directions. The beetles in each column face alternately thirty degrees to one side of the column's long axis, and thirty degrees to the other side of the axis. This last sort of tiling by the Rotate-Rotate subset is the basis, or the matrix, for tilings that may be formed by seven more subsets. Each of five of these subsets will tile the plane with an infinite number of unique tilings. A list giving the members of these five subsets follows.

(1) Rotate-Rotate subset and Snake-Snake subset combined.

(2) Rotate-Rotate subset and Snake-Rotate subset and Rotate-Snake subset combined.

(3) All eight beetle tiles together as one subset of the eight member set.

(4) Rotate-Rotate subset and Snake-Snake subset and the small or skinny-bodied members of both the Rotate-Snake and the Snake-Rotate subsets.

(5) Rotate-Rotate subset and Snake-Snake subset and the fat-bodied members of both the Rotate-Snake and the Snake-Rotate subsets.

In each of the tilings by these five subsets the alternating columns of the two members of the Rotate-Rotate subset can be considered the matrix across which side-by-side ranks of the other tiles may be assembled at varying intervals. FIG. 8 shows such a matrix of the Rotate-Rotate subset consisting of the columns labeled X, X', X", X'", Y, Y', Y", and Y'". This matrix is crossed by aside-by-side rank of the Snake-Snake subset along the line in the drawing labeled Z.

The variability of the intervals at which ranks of other beetles may be assembled in a matrix of tiles of the Rotate-Rotate subset allows a unique tiling to be assembled corresponding to each member of the natural number series. For instance, a tiling by the Rotate-Rotate subset across which there is a single rank of members of the Snake-Snake subset might correspond to the number one. A second similar tiling having two ranks across might correspond to the number two, and so on. Since the number series is infinite, so is the number of the unique tilings that may correspond to them. Each of the five subsets listed above can, in this way, provide an infinite number of unique tilings.

The most visually interesting of the tilings produced by these five subsets are those having all eight beetle shapes distributed throughout the tiling and employing a minimum, or near minimum, number of beetles of the Rotate-Rotate subset.

There are two more subsets each of which is capable of tiling the plane with the members of the Rotate-Rotate subset acting as a matrix. (1) The first is made up of four beetles: the two members of the Rotate-Rotate subset; the skinny-bodied member of the Rotate-Snake subset; and the skinny-bodied member of the Snake-Rotate subset. A side-by-side rank of these skinny-bodied beetles in alternation can be assembled across one end of a straight-column tiling by the Rotate-Rotate subset. The tiling by the rotate-Rotate subset can then be continued, but the beetles of the Rotate-Rotate subset which are now assembled into the tiling will all face in directions opposite to those of beetles in the previously assembled portion. As a consequence of this no more skinny-bodied beetles can be assembled into the tiling regardless of its extent. (2) The second of these final two subsets operates in an exactly similar manner to the first, but instead of skinny-bodied beetles, the fat-bodied beetles from the same two subsets are used. Combining these final two subsets would make up one of the subsets which can produce an infinite number of different tilings.

An unlimited number of puzzles of every level of difficulty can easily be devised using movable pieces having the eight different beetle shapes. One way to make such puzzles with the beetle tiles is as follows: (1) Assemble a patch of tiles on a blank piece of paper. The patch can be large or small, simple or complex. (2) Closely trace the outline of the patch of tiles onto the piece of paper. (3) Remove the tiles and present the traced outline, as a puzzle to be accurately filled in with tiles, to another person. For a competitive game, two or more identical outlines can be made, so that two or more persons can compete for the quickest solution.

All the beetle tilings discussed herein, with the exception of the concentric hexagon tilings formed by the Rotate-Rotate subset, will tile cylindrical surfaces without gap or lap as well as flat surfaces that more or less resemble the Euclidian plane.

Ramifications and Scope

The eight-beetle set of tiles of this invention can be used in decorative motifs for any plane or cylindrical surface, such as in architecture, room decor, wall and floor coverings, fabrics, clothing, and so on. The eight-beetle set can also be used to design space-efficient molds for novelty foods or candies, or to design cylindrical dies for cutting and/or embossing sheet materials into beetle shapes without production of scrap. Such sheet materials include pasteboard, as in one sort of puzzle-piece production, and various edible doughs as in cookie production.

There are ten subsets of the eight-beetle set which will tile the plane. Since five of these will do so in an infinite number of different ways, truly unlimited numbers of different puzzles can be devised of the sort where a given outline is to be filled in with beetle-shaped game pieces. Free recreational play using beetle-shaped game pieces is spontaneous when people begin to explore the very many ways that the pieces fit together. Assembling beetles in such a freely ad-lib way can teach both hand-eye coordination and the perception of shapes in an attention-holding way. The beetle shapes can be used as designs for single-beetle pieces of jewelry, or a linked and flexible tiling of them could form a plastron. Linear friezes of beetles could form necklaces, bracelets, and the like.

Although the descriptions in this specification are highly specific, they should not be construed as limiting the scope of the invention, but as merely providing illustrations of the embodiment of this invention which is preferred at the present time. For example, many small variations of the pattern line which is used herein to produce the favored embodiment shown in the drawings will produce sets of shapes having different characters, some perhaps having thicker "necks" or differently bent and shaped legs. Doubling the recurved line will even produce twelve-legged shapes.

Thus the scope of the invention should be determined by the appended claim and its legal equivalents, rather than by the examples given.

Accordingly, what I claim is as follows:

1. A set of eight different bilaterally symmetrical and variably assemblable figurative tiles formed from eight regular hexagons all of the same size and formed by (a) using an asymmetrical and recurved pattern, moved in the plane, to replace each of three contiguous sides of each of said hexagons so that each of the eight possible arrangements of three differently oriented contiguous sides forms a hemiperimeter of one of said hexagons, and (b) reflecting the respective hemiperimeter as a unit to replace the three remaining unmodified sides, thus completing each of the eight different bilaterally symmetrical and variably assemblable figurative tiles.

* * * * *